US010166487B2

(12) United States Patent
Snyder

(10) Patent No.: US 10,166,487 B2
(45) Date of Patent: Jan. 1, 2019

(54) FLIGHT CAPABLE IMITATION BALLOON WHICH MIMICS THE MOVEMENTS OF A HELIUM-FILLED BALLOON

(71) Applicant: Jordan Snyder, San Diego, CA (US)

(72) Inventor: Jordan Snyder, San Diego, CA (US)

( * ) Notice: Subject to any disclaimer, the term of this patent is extended or adjusted under 35 U.S.C. 154(b) by 0 days.

(21) Appl. No.: 15/501,524

(22) PCT Filed: Nov. 10, 2015

(86) PCT No.: PCT/US2015/060043
§ 371 (c)(1),
(2) Date: Feb. 3, 2017

(87) PCT Pub. No.: WO2016/077400
PCT Pub. Date: May 19, 2016

(65) Prior Publication Data

US 2017/0225088 A1 Aug. 10, 2017

Related U.S. Application Data

(60) Provisional application No. 62/080,377, filed on Nov. 16, 2014.

(51) Int. Cl.

| | |
|---|---|
| ***A63H 27/00*** | (2006.01) |
| ***A63H 33/00*** | (2006.01) |
| ***A63H 27/10*** | (2006.01) |

(52) U.S. Cl.
CPC ..... *A63H 27/10* (2013.01); *A63H 27/00* (2013.01); *A63H 33/00* (2013.01); *A63H 2027/1008* (2013.01); *A63H 2027/1091* (2013.01)

(58) Field of Classification Search
CPC ..... A63H 27/00; A63H 27/10; A63H 29/00; A63H 33/00; G09F 19/00
See application file for complete search history.

(56) References Cited

U.S. PATENT DOCUMENTS

| | | | | |
|---|---|---|---|---|
| 3,204,891 A * | 9/1965 | Cline | A63H 27/12 244/23 R |
| 7,273,195 B1 * | 9/2007 | Golliher | A63H 27/12 244/17.11 |
| 8,012,549 B1 * | 9/2011 | Doute | G09F 21/04 428/31 |
| 2004/0094662 A1 * | 5/2004 | Sanders, Jr. | B64C 27/20 244/12.5 |
| 2010/0224723 A1 * | 9/2010 | Apkarian | A63H 27/12 244/65 |
| 2014/0099853 A1 * | 4/2014 | Condon | G05D 1/0033 446/37 |

* cited by examiner

*Primary Examiner* — Gene Kim
*Assistant Examiner* — Alyssa Hylinski
(74) *Attorney, Agent, or Firm* — Peter Gutenberg

(57) ABSTRACT

The present invention relates to a powered, flight capable, air-filled balloon which mimics the movement of a helium-filled balloon.

6 Claims, 8 Drawing Sheets

FLIGHT CAPABLE IMITATION BALLOON WHICH MIMICS THE MOVEMENTS OF A HELIUM-FILLED BALLOON

CROSS-REFERENCE TO RELATED APPLICATIONS

This application claims the benefit of Patent Cooperation Treaty application number PCT/US2015/60043, filed 10 Nov. 2015, which in turn, claims the benefit of U.S. application No. 62/080,377, filed 16 Nov. 2014, both of which are incorporated herein by reference.

FIELD AND BACKGROUND OF THE INVENTION

1. Field of the Invention

The field of the invention relates to a flight capable, air-filled balloon, specifically, a flight capable air-filled imitation balloon, which mimics the movements of a helium-filled balloon.

2. Background of the Invention

Balloons have been used for many years, as among other uses, toys and decorations at parties, being popular amongst children and adults alike. The bright colors and playful nature of balloons have fascinated people of all ages from infancy all the way to old age. Helium-filled balloons, with their whimsical movements, seem to fascinate every age group. Balloons have become synonymous with parties because of their wide spread use at parties and events that bring joy. Because of the nearly universal use of balloons at parties and happy events, they automatically create a favorable association in the minds of people of all ages. When a person driving down the road happens upon a cluster of brightly colored balloons, unexpectedly, attention is automatically drawn to that point. Some businesses have even developed a permanent and continuous use for balloons as a sales enhancer. Balloons are often inflated with air or a lighter than air gas, such as helium or hydrogen.

However, there are many serious drawbacks, associated with the use of balloons. Balloons are known to suddenly pop, which can cause hearing damage or eye injuries. The bright colors of many balloons, which make them visually appealing, also draw young children to a deflated balloon, creating a choking hazard. Many of these balloons are single use, meaning that once they break or deflate, they are thrown away as garbage; as many of the plastics used in these balloons are slow to degrade, the balloon will take up space in landfills for many years to come. In addition, these plastics are often consumed by the wildlife which live in these landfills and might result in choking; or run-off into sewer and water supply.

Air-filled balloons do not float and must be attached to a post or other solid object; this negates the effect of the balloon's movements, which many people enjoy. Many people enjoy the whimsical movements provided by a helium balloon, which is not replicated by an air-filled balloon. While hydrogen is a cheap and abundant, lighter than air gas, its flammable properties are well known, making hydrogen ill-suited for use in the general public.

Helium is often the lighter than air gas of choice, in that it is safe for use while in the balloon. However, the use of helium in balloons have several drawbacks. First, the price of helium has greatly increased over the last decade. This is because there is a finite supply of helium, known supplies of the gas have dwindled and it is impossible to synthetically manufacture helium. Second, helium is able to seep through plastic pores and will deflate often within days. Third, unless extremely tethered to a user or a post, helium filled balloons will float way, either when a person lets go or they become untied from their mooring. These escaped, helium-filled balloons can fly for many miles; if they land in an ocean or other body of water, they may be ingested by birds, fish and other water dwelling creatures, who subsequently choke on the balloon. If left to degrade, the plastics in these balloons is known to degrade into small pellets of plastic where they are consumed by fish; the toxins in these plastics, in addition to being fatal, may find their way up the food chain and cause harm to the human food supply.

Furthermore, helium is typically sold in compressed cylinders. These cylinders are very heavy and when purchased, must be stored in a convenient and safe location; the balloons must be brought to the cylinder to be filled. It may be impractical to move a helium cylinder around from location to location to fill balloons. While helium-filled balloons are associated with parties and happiness, the heavy weight of helium cylinders has been responsible for many back lifting injuries. The cylinders also have a high compressed gas pressure and have to be treated with strict safety precautions. Finally, another resulting safety concern, is filling balloons with helium, placing them in a vehicle with the occupants, and driving; vision can become completely obstructed by floating balloons that get loose.

A safer, affordable, and re-usable alternative to helium-filled balloons is desirable. The present invention provides an affordable, re-usable, safe, air-filled alternative to a helium-filled balloon.

SUMMARY OF THE INVENTION

In view of the foregoing disadvantageous factors inherent in inflatable balloons, the present invention provides an affordable, re-usable, safe, air-filled alternative. The general purpose of the present invention, which will be described subsequently in greater detail, is to mimic the aesthetic appearance and movements of air or helium-filled balloons yet avoiding the expenses, and associated safety hazards.

In its preferred embodiment, this invention consists of a body or balloon portion, which appears like a balloon, connected to a cable, which is in turn, attached to a control unit. Two counter-rotating fans contained within the balloon portion draw air in through air intake vents. Air is fed through the fans and exits through two sets of exhaust vents, vertical and horizontal. Air flowing out from the vertical exhaust vents provides thrust, causing the balloon portion to elevate and hover; while air flow from the horizontal exhaust vents acts to stabilize the balloon portion. The counter-rotation, provides additional stability to the balloon portion. The fans are connected to a motor, by way of a drive shaft, which turns the fan's blades. Commercially available disposable or rechargeable batteries in the control unit provide power to the motor, through a cable connecting the control unit to the motor in the balloon portion. Both cable ends are USB connectors, allowing for detachment from the control unit, attachment to and drawing power from a USB enabled device, such as a desktop, laptop or tablet computer. In the preferred embodiment the control unit is either a wrist worn or handheld device.

Various alternative embodiments are envisioned. In one embodiment, lacking a control unit, batteries are contained within the balloon portion; the fans are activated/deactivated by a switch located at the base of the balloon portion. Under another embodiment, the control unit is in the form of a desktop base. Power is supplied either from commercially available batteries located in the base, a solar array either on or embedded in the surface of the base, or through a power cord to a USB port or household electric plug. Under yet another embodiment, the device lacks a control unit and instead, the cable plugs directly into a USB enabled device. Under yet another embodiment, the device is powered through a solar array, located on or embedded in the balloon portion. A switch located adjacent to the solar array powers the fans on and off.

Under yet another embodiment, the balloon portion contains a processing unit and control valves in the horizontal exhaust tubes. The processing unit is connected to control valves located in the horizontal exhaust tubes, and a USB connector. The USB connector allows for the upload of flight instructions from a USB enabled device, such as a smartphone, computer or tablet. Flight is controlled from the processing unit through the opening and closing of the control valves.

Other features and advantages of the present invention will become more readily apparent to those of ordinary skill in the art after reviewing the following detailed description and accompanying drawings.

BRIEF DESCRIPTION OF THE DRAWINGS

These and other objects, features, and aspects of the invention will be better understood and more fully described upon reading the following detailed description in conjunction with the appended drawings wherein.

DETAILED DESCRIPTION

Figure 1:
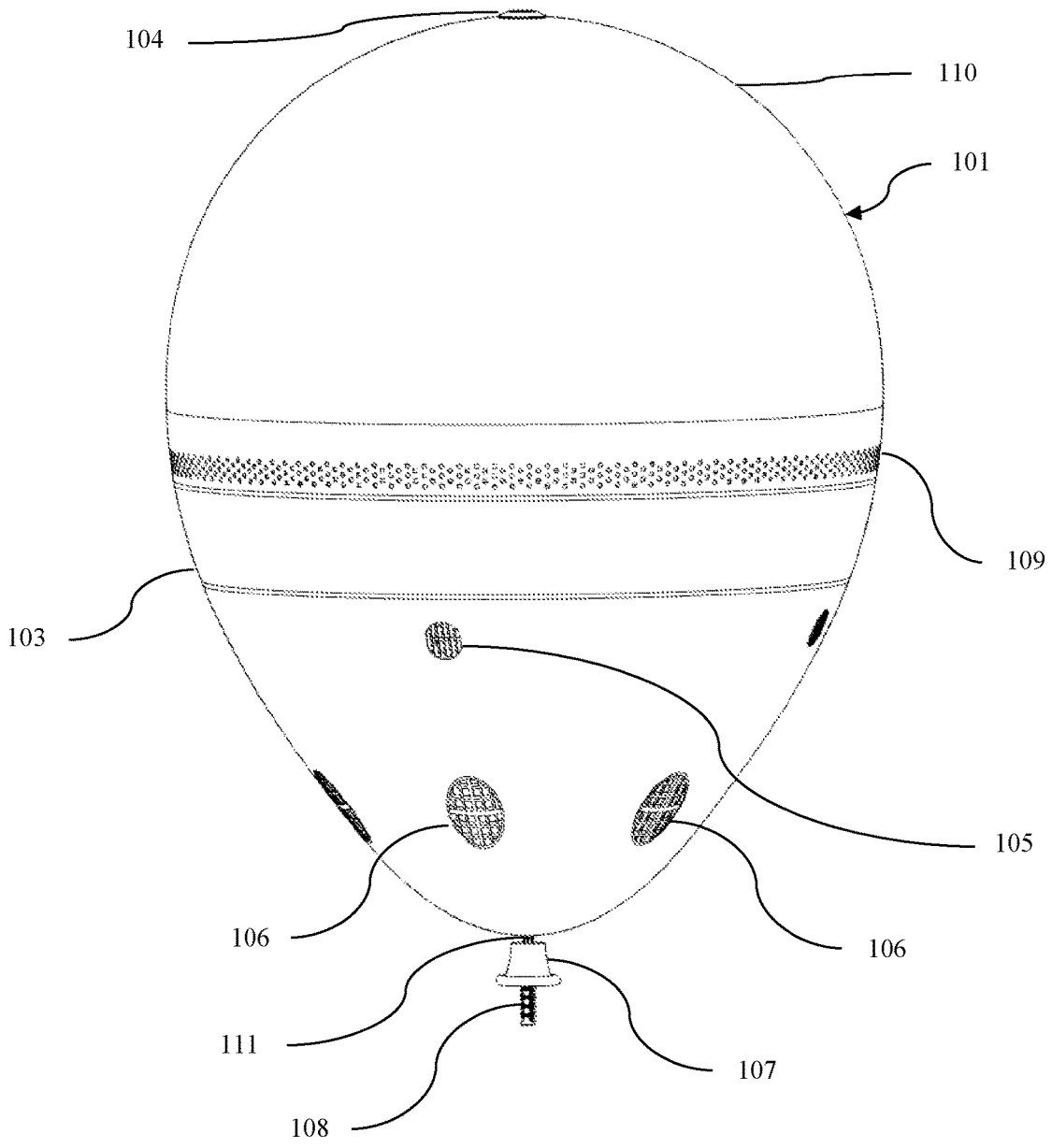
FIG. 1 is a frontal view of the outside of the balloon portion of the invention.

Certain embodiments as disclosed herein provide for a balloon toy and method of use. After reading this description it will become apparent to one skilled in the art how to implement the invention in various alternative embodiments and alternative applications. Although various embodiments of the present invention will be described herein, it is understood that these embodiments are presented by way of example only, and not limitation. As such, this detailed description of various alternative embodiments should not be construed to limit the scope or breadth of the present invention.

As the balloon is a spherical or semi-spherical object, geographic references will be used to describe. North and south will be used to describe the top and lower halves of the balloon; pole will be used to describe the northern- or southernmost point. Equator will be used to describe a line around the sides of the balloon, equidistant from the northern and southern poles. Longitudinal refers to a direction perpendicular to the poles. The term "knot" refers to a structure attached to the south pole of the balloon, which mimics the knot, which is typically used to seal convention air- or helium filled balloons Referring now to FIGS. 1 through 4 which depict the preferred embodiment of the invention, a flight capable imitation balloon which mimics the movements of a helium-filled balloon. The body or balloon portion 101 consists of two compartments a northern half 102 and a southern half 103. Both halves may be rigid or semi-rigid and contain mechanisms for flight and flight control; the southern half 103 is hollow; the northern half 102 is either an empty compartment or a solid piece. Contained in the southern half 103 are the fan assembly 205, two fans 203 and 204, drive shaft 209, motor 210, vertical exhaust assembly 207, multiple air intake vents 109, horizontal exhaust tubes 206, and vertical and horizontal exhaust vents 105 and 106, respectively. Power is supplied through a cable 108 from a control unit 302, containing a power supply. At the south pole 111 of the southern half 103 of the balloon is a pyramidal-like structure, henceforth referred to as the "knot;" 107. Contained within the knot 107 is a USB connector 201, which allows for connection to the cable 108.

The materials used to fabricate the balloon portion 101 are provided from any suitable source such as, but not limited to, metal, wood, plastics, and the like as well as a combination thereof. Preferably, durable and light weight plastic materials are preferred such as, but not limited to, MYLAR®, siliconized rubber, high density polyethylene, polypropylenes, polysulfones, and polystyrenes.

Turning now to FIG. 1, which depicts a frontal view of the balloon portion 101. In the preferred embodiment, the balloon portion 101 is semi-spherical; the northern half 102 of the balloon portion 101, is spherical, while the southern half 103 is tapered. Situated on the exterior of the southern half 103 of the balloon portion 101 are air intake vents 109, vertical exhaust vents 106 and horizontal exhaust vents 105. A plurality of air intake vents 109 circumnavigate the balloon portion 101, just above the equator. The vertical exhaust vents 106 are situated on the southern half 103 of the balloon portion 101, below the equator, so that the vertical exhaust directs air downward and provides lift for the balloon portion 101, when the fans are activated. In the preferred embodiment of this invention, there are six vertical exhaust vents 106, spaced equidistantly, around the outside of the balloon, below the equator; however, greater or fewer vents may be utilized. The horizontal exhaust vents 105, are situated south of the equator, facing outward; these horizontal exhaust vents 105 provide stability and allow the balloon to move around in a random motion, simulating the movements of a helium-filled balloon. A valve 104 on the northern half 102 of the balloon allows for the northern half 102 to be compacted for transport, allowing for re-inflation either manually by an operator or with a commonly available pump with a needle inflator.

Figure 2:
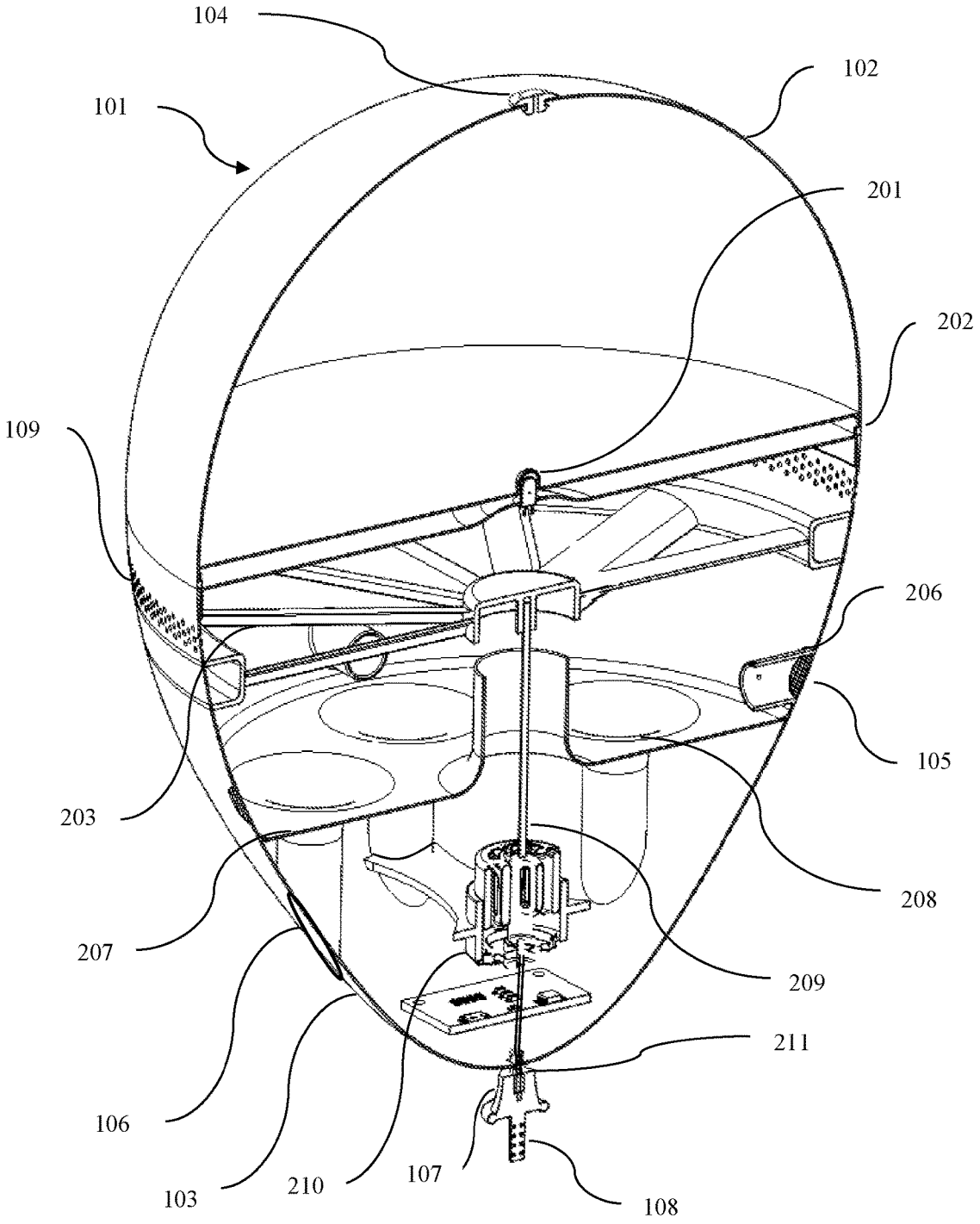
FIG. 2 is a longitudinal cutaway view of the invention of the balloon portion of the invention. The lower fan has been removed.

Turning now to FIG. 2, which depicts a longitudinal hemispherical cutaway of the balloon portion 101. The balloon portion 101 is separated into northern 102 and southern 103 halves. The northern half 102 is detachable from the southern half 103 by way of a variety of means such as locking notch, clip or Velcro® straps. Contained within the southern half 103 of the balloon portion 101 is the fan assembly, fans, multiple horizontal exhaust tubes, a vertical exhaust assembly containing multiple vertical exhaust tubes; drive shaft 209 and motor 210.

The fan assembly 205 is secured to the inner sides of the southern half 103 of the balloon portion 101, planar and substantially parallel to the equator; two fans, an upper fan 203 and a lower fan 204, situated in the center of the fan assembly 205, one on top of the other. During operation, the fans 203 and 204 counter-rotate to provide stability to the balloon portion 101 while activated. The drive shaft 209 connects at the center of the fans and leads north south to the motor 210. In some embodiments, the balloon unit will carry an LED light 201, camera, speaker and/or microphone.

Figure 3:
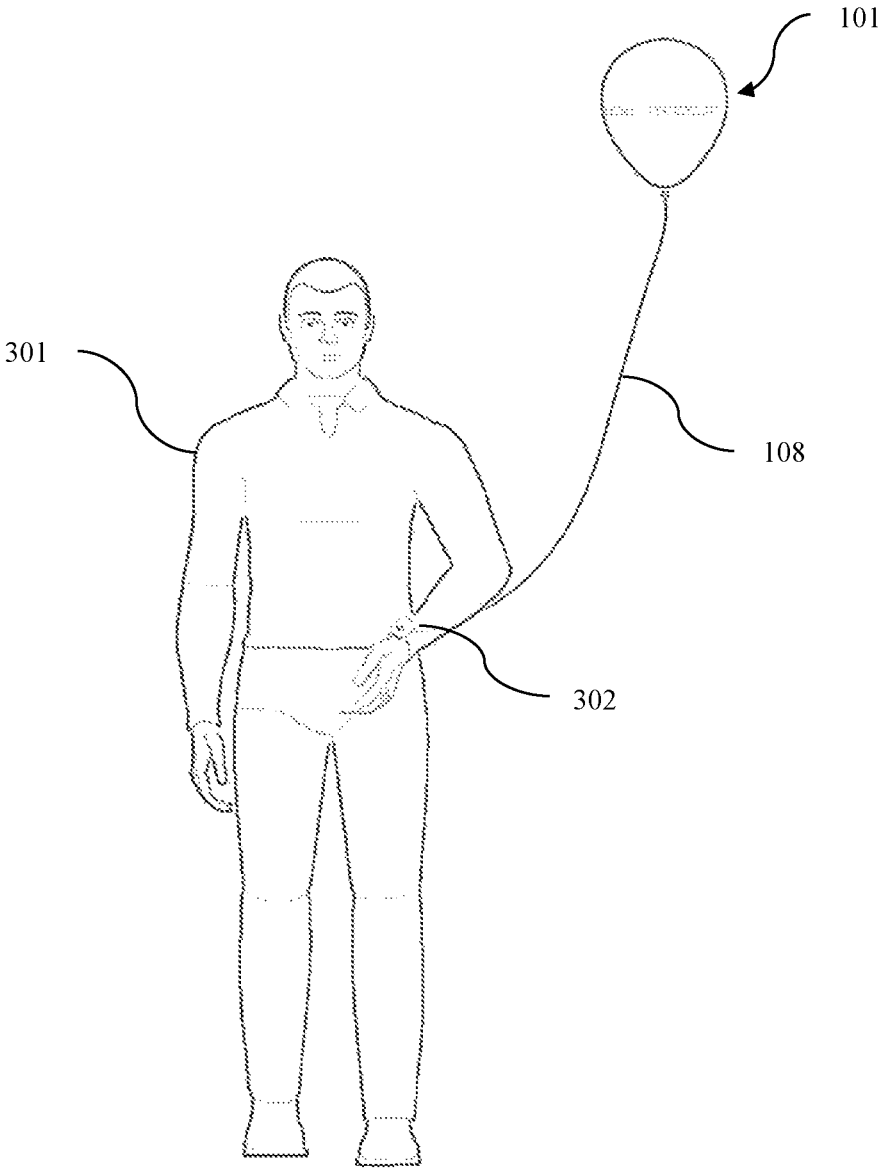
FIG. 3 is a view of one embodiment of the invention in use by an individual.
Figure 4:
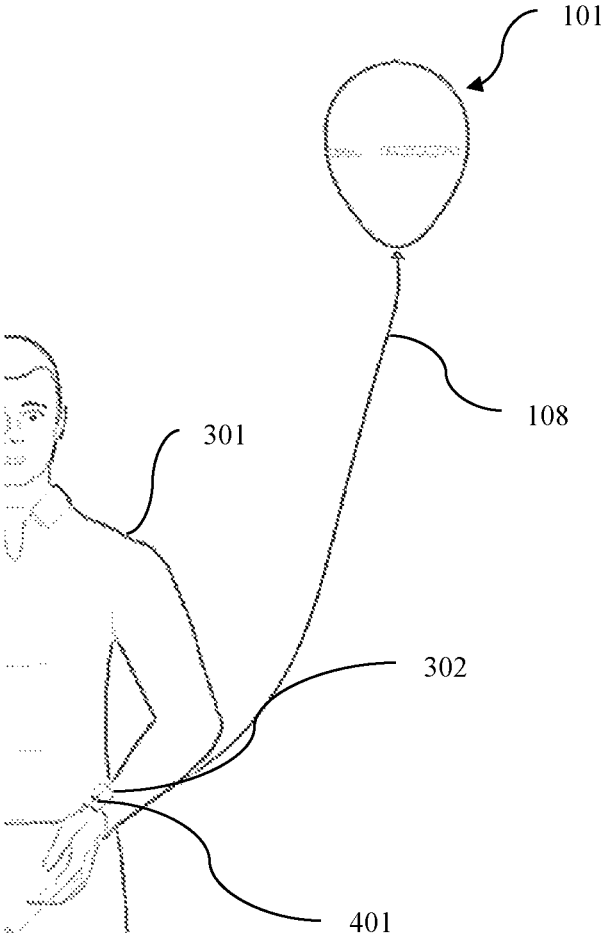
FIG. 4 is a blow-up view of the control unit on a user's wrist.

In this preferred embodiment, a separate control unit 302 provides power to the motor 210 and fan of the balloon portion 101. Turning to FIG. 3, the control unit is in the form of a wrist mounted device 302; however, other embodiments may utilize a handheld device for the control unit. Located within the control unit 302 is the power supply consisting of commercially available batteries. In the preferred embodiment, these batteries, may be commercially available disposable or rechargeable batteries. A power switch 401 located on the surface of the control unit 302, activates/deactivates the device. The cable 108 runs from the control unit, through the south pole of the balloon portion 101. Locking USB connectors 211 at each end of the cable 108 serve to both anchor the balloon portion 101 to the control unit 302 and transmit electrical power from the power source to the motor 210.

When activated, power from the power source is transmitted through the cable 108. This powers the motor 210, causing the fans 203 and 204 to turn and draw air in from the air intake vents 109. This air is drawn through the fan blades, and flows into horizontal and vertical exhaust vent tubes 206 and 208 respectively and out the horizontal and vertical vents 105 and 106, respectively. The horizontal vent tubes 206 are located below the fan assembly 205 and channel air through the horizontal exhausts 105. In the preferred embodiment, there are four horizontal exhaust tubes 206, each connecting to a corresponding horizontal exhaust vent 105, located on the surface of the balloon portion 101; however, other embodiments, may utilize more or fewer horizontal exhaust tubes 206 and corresponding exhaust vents 105. The horizontal exhaust allows the balloon portion 101 to move randomly, parallel to the ground and provides stability. The vertical exhaust tubes 208, are disposed perpendicular to the equator and connect to the vertical exhaust vents 106. The air exhaust pushed through the vertical exhaust tubes 208 and vents 106, creates lift, which causes the balloon portion 101 to elevate or hover.

Figure 5:
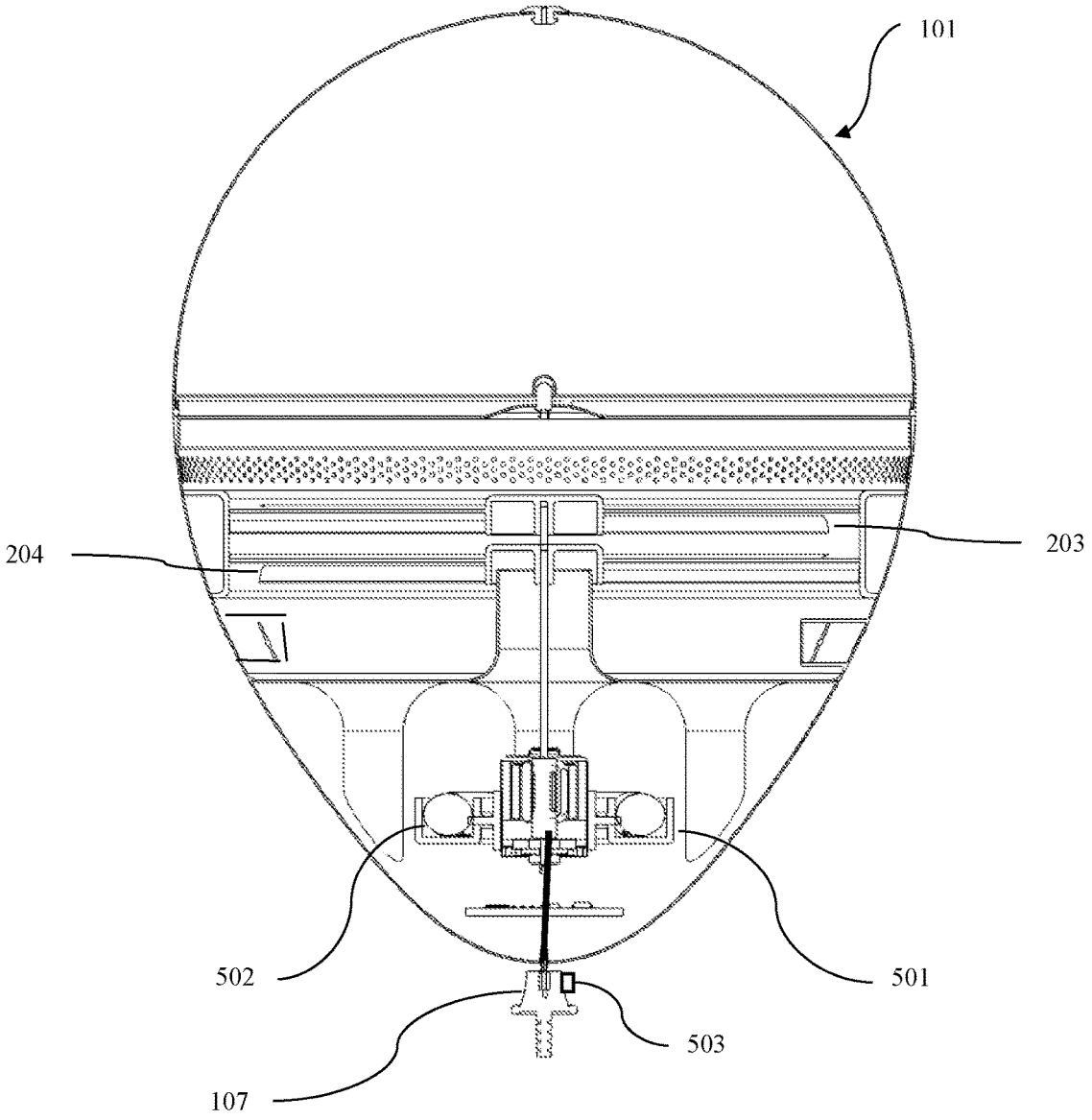
FIG. 5 is a longitudinal profile view of one embodiment of the invention, in which batteries are housed inside the balloon portion.

Turning now to FIG. 5, under a second embodiment, batteries 501 are housed in a battery assembly 502, located in the south half 103 of the balloon portion 101, next to a motor 210. Power is controlled through a power switch 503 located on a knot. The weight of the batteries 501 and battery assembly 502 are of sufficient weight as to prevent the balloon portion 101 from floating away.

Figure 6:
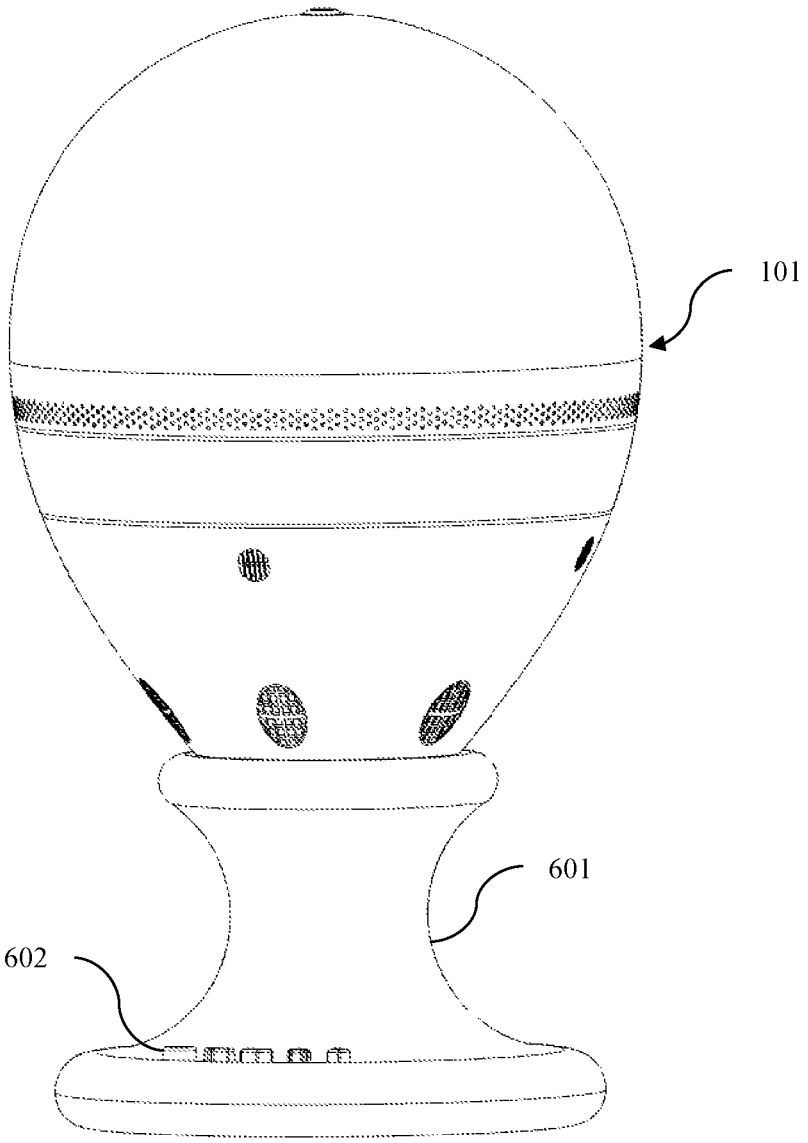
FIG. 6 is a view of a one embodiment of the invention, where the balloon portion is inactive and sitting in a base unit.
Figure 7:
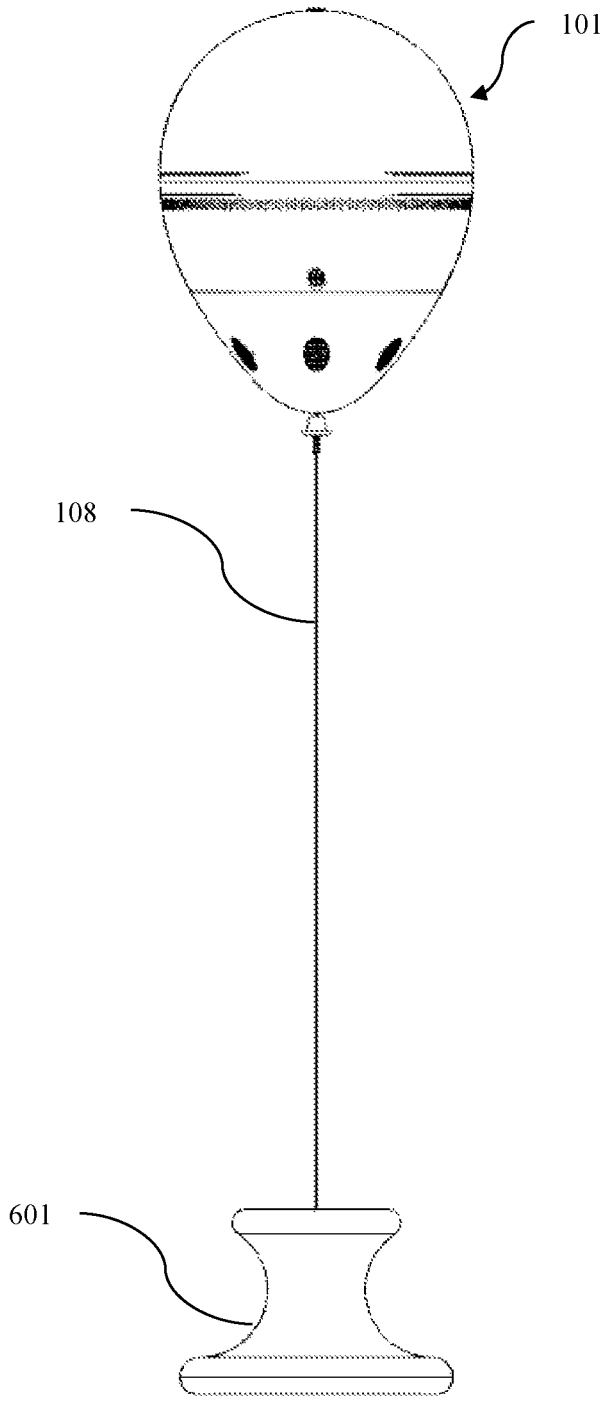
FIG. 7 is a view of one embodiment of the invention, where the balloon portion is active and hovering above a base unit.
Figure 8:
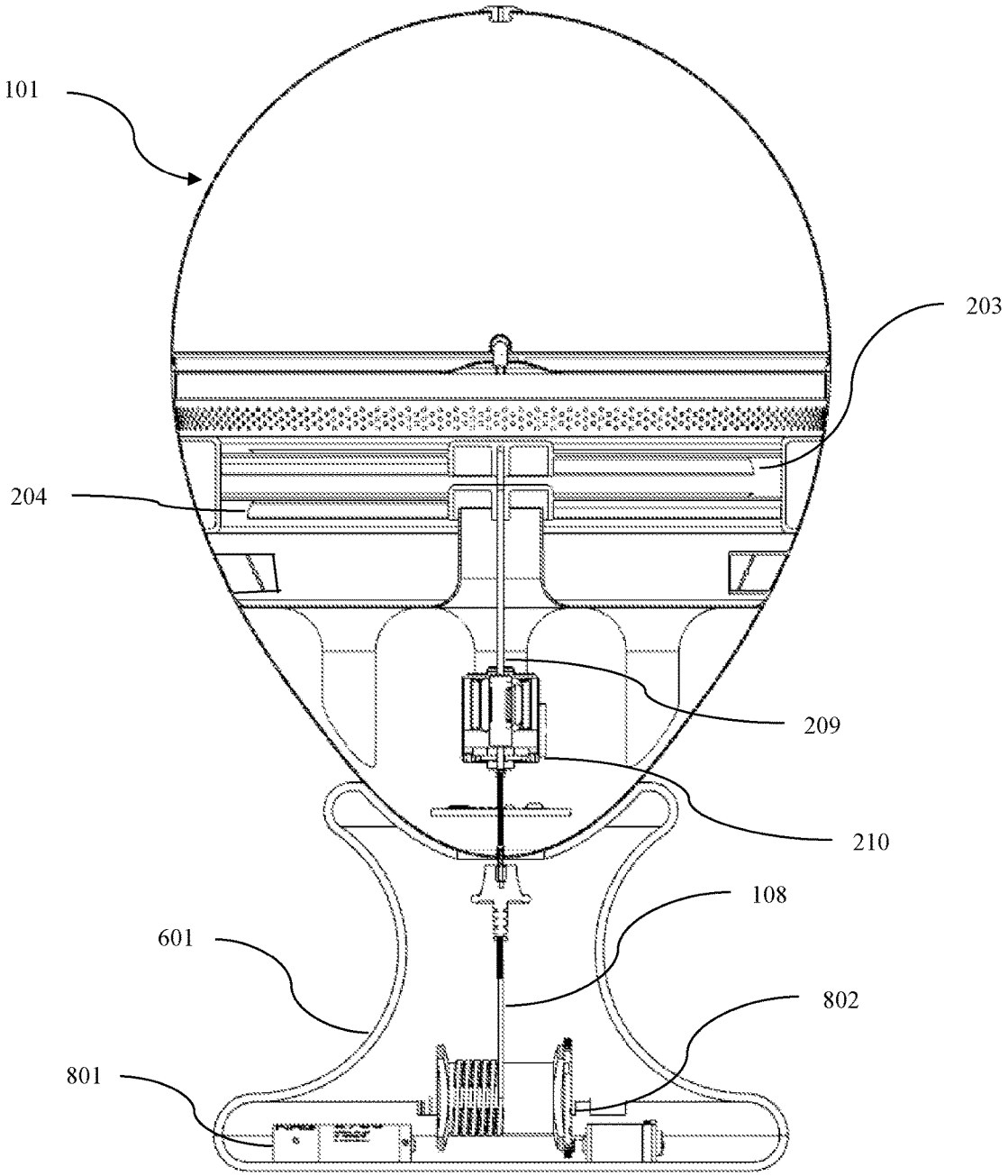
FIG. 8 is a view of a longitudinal cutaway profile view of one embodiment of the invention, where the balloon portion is inactive and sitting in a base unit.

Turning now to FIGS. 6, 7 and 8, under a third embodiment of the invention, a balloon portion 101, through a connecting cable 108, is attached to a desktop base unit 601, instead of a hand held or wrist wrapping control unit. A power switch 602 on the base unit 601 activates and deactivates the motor 210 and fans 203 and 204, causing the balloon portion 101 to elevate or deactivate and lower to the base unit. While inactive, the cable 108 is coiled within a reel 802 within the base. Upon activation the reel 802 releases the cable 108 and the balloon portion 101 rises. When the power is switched off, the reel retracts the cable and the balloon portion 101 settles on the base. Multiple power sources may be utilized, including, but not limited to: solar cells located on the surface of the balloon portion 101; solar cells located on the base unit or northern half 102 of the balloon portion 101; commercially available rechargeable or recyclable battery, such as AA, rechargeable LiOH; or through a power cord to a household power socket; or directly through a power cord with a USB connector, allowing for connection to any device with a USB port.

A fourth embodiment of the invention lacks a control unit; the both ends of the cable 108 contain USB connectors, which may connect to any device with a USB port. Examples of USB enabled devices include desk and laptop and/or tablet computers. When attached to a device with a USB port, power is drawn from the USB port, through the cable 108, activating a motor 210 and fans 203 and 204, causing the balloon portion 101 to ascend.

A fifth embodiment of the invention is powered by a solar cell, either embedded in the upper portion of a balloon portion or positioned on the balloon portion's 101 surface. Power is controlled by power switch on the balloon portion's surface, next to the solar cell. The balloon portion 101 may be attached to a counter weight to prevent it from flying off. A string or cord may attach to the bottom of the balloon, allowing a user to handle the balloon portion like a toy.

A sixth embodiment of the invention contains a processing unit in the balloon portion, an internal power source and a control valve located in each of the horizontal exhaust tubes. The processing unit is connected to a USB connector at a south pole of a balloon portion and the control valves. The USB connection allows for the uploading of flight directions to the processing unit and charging of the power source from a USB enabled device, allowing for pre-programmed flight. Flight is controlled by opening and closing control valves. Multiple power sources may be utilized, including, but not limited to: solar cells located on the surface of the balloon; solar cells located on the base unit or northern half of the balloon portion; commercially available rechargeable or recyclable battery, such as AA, rechargeable LiOH. Power is controlled by power switch on a knot.

Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

I claim:

1. A flight capable imitation balloon which mimics the movements of a helium-filled balloon comprising: a body portion, a substantially pyramidal member, an exhaust assembly, a fan assembly, a motor, a drive shaft, two fans, a plurality of air intake vents, a plurality of horizontal exhaust vents, a plurality of vertical exhaust vents, a cable, a control unit, a power source, and a power switch; wherein said body portion is semi-spherical, with a substantially hemispherical northern half and semi-hemispherical southern half; wherein said semi-hemispherical southern half has a non-tapered top and tapered bottom; wherein the northern half and the southern half are detachable above an equator of the semi-spherical body portion; wherein the substantially pyramidal member contains a USB connector and connects to the tapered end of said southern half; wherein the plurality of air intake vents circumnavigate the non-tapered portion of the southern half; wherein the plurality of horizontal exhaust vents circumnavigate the non-tapered portion of the southern half, below said air intake vents; wherein the plurality of vertical exhaust vents are substantially parallel to said tapered end of said southern half; wherein said fan assembly is attached to an inside surface of a lower half, below said air intake vents; wherein said two fans are contained within said fan assembly, substantially perpendicular to said tapered end; wherein said fans provide enough lifting capacity to lift said body portion; wherein said two fans are a top fan and a bottom fan; wherein said exhaust assembly is attached to the inside of said lower half, below said fan assembly; wherein a plurality of tubes run from said exhaust assembly to said exhaust vents; wherein said exhaust assembly conducts air; wherein said motor is attached to said exhaust assembly; wherein said drive shaft connects said motor and said fans; wherein said motor provides power to rotate said drive shaft and said fans; wherein said motor is attached to the USB connector of said pyramidal member; wherein said cable has a first end and a second end; wherein both ends of said cable are USB connections; wherein one end of said cable attaches to said control unit and said second end connects to said USB connection located in said pyramidal member; wherein the power source is located in said control unit; wherein the power switch is located on said control unit; wherein activating said power switch causes the fans to activate; wherein said fans draw in air from said air intake vents; wherein air is drawn through said fans and exits said body portion through said horizontal exhaust vents and said vertical exhaust vents; wherein air exiting said vertical exhaust vents lifts said body portion; wherein air exiting said horizontal exhaust vents stabilizes said body portion; wherein said counter-rotating fans stabilize said body portion.

2. The flight capable imitation balloon which mimics the movements of a helium-filled balloon of claim 1, wherein the control unit is a wrist mounted or handheld unit; wherein said power source consists of commercially available disposable or rechargeable batteries.

3. The flight capable imitation balloon which mimics the movements of a helium-filled balloon of claim 1, wherein the control unit is a desktop base; wherein a reel is located inside said base; wherein said cable is spooled around said reel when power is disconnected; wherein said cable unspools from said reel, when power is activated; wherein said power source consists of commercially available disposable or rechargeable batteries, a solar array located on the desktop base unit or northern half of the body portion, a power cord attached to a household power supply or a USB connection to a USB enabled device.

4. The flight capable imitation balloon which mimics the movements of a helium-filled balloon of claim 1, wherein the cable disconnects from said control unit, connects to and draws power from a USB enabled device power supply.

5. The flight capable imitation balloon which mimics the movements of a helium-filled balloon of claim 1, further comprising a processing unit and a plurality of horizontal exhaust vent control valves; wherein a horizontal exhaust vent control valve is attached to each of horizontal exhaust vents; wherein said processing unit is connected to a USB connection; wherein flight control instructions are uploaded to said processing unit through said USB connection from a USB enabled device; wherein flight is controlled by said processing unit through the opening and closing of the horizontal exhaust vent control valves; wherein the power source is an internal battery or solar array located on or embedded in said northern half of said body, wherein a power switch, located on a knot or said solar array, activates and deactivates said flight capable imitation balloon which mimics the movements of a helium-filled balloon.

6. A flight capable imitation balloon which mimics the movements of a helium-filled balloon comprising: a body portion, a substantially pyramidal member, an exhaust assembly, a fan assembly, a motor, a drive shaft, two fans, a plurality of air intake vents, a plurality of horizontal exhaust vents, a plurality of vertical exhaust vents, a cable, a control unit, a power source, and a power switch; wherein said body portion is semi-spherical, with a substantially hemispherical northern half and semi-hemispherical southern half; wherein said semi-hemispherical southern half has a non-tapered top and tapered bottom; wherein the northern half and a southern halves are detachable above an equator of the semi-spherical body portion; wherein the substantially pyramidal member connects to the tapered end of said southern half; wherein a string or cord is attached to said pyramidal member; wherein the plurality of air intake vents circumnavigate the non-tapered portion of the southern half; wherein the plurality of horizontal exhaust vents circumnavigate the non-tapered portion of the southern half, below said air intake vents; wherein the plurality of vertical exhaust vents are substantially parallel to said tapered end of said southern half; wherein said fan assembly is attached to an inside surface of a lower half, below said air intake vents; wherein said two fans are contained within said fan assembly, substantially perpendicular to said tapered end; wherein said fans provide enough lifting capacity to lift said body portion; wherein said two fans are a top fan and a bottom fan; wherein said top and bottom fans counter-rotate; wherein said exhaust assembly is attached to the inside of said lower half, below said fan assembly; wherein a plurality of tubes run from said exhaust assembly to said exhaust vents; wherein said exhaust assembly conducts air; wherein said motor is attached to said exhaust assembly; wherein said drive shaft connects said motor and said fans; wherein said motor provides power to rotate said drive shaft and said fans; wherein the power source is a solar panel array; wherein said solar array is located on or embedded in said northern half of said body portion; wherein said control unit is located on or embedded in said northern half of said body portion, adjacent to said solar array; wherein said control unit connects said solar array to said motor; wherein the power switch is located on said control unit; wherein activating said power switch causes the fans to activate; wherein said fans draw in air from said air intake vents; wherein air is drawn through said fans and exits said body portion through said horizontal exhaust vents and said vertical exhaust vents; wherein air exiting said vertical exhaust vents lifts said body portion; wherein air exiting said horizontal exhaust vents stabilizes said body portion; wherein said counter-rotating fans stabilize said body portion.

* * * * *